United States Patent [19]

Kitashima et al.

[11] 4,084,473

[45] Apr. 18, 1978

[54] ELECTRIC PIANO

[75] Inventors: Riichi Kitashima, Iwata; Masakazu Matsumoto; Shinji Tagaki, both of Hamamatsu, all of Japan

[73] Assignee: Kabushiki Kaisha Kawai Gakki Seisakusho, Hamamatsu, Japan

[21] Appl. No.: 714,267

[22] Filed: Aug. 13, 1976

[30] Foreign Application Priority Data

| | | |
|---|---|---|
| Aug. 19, 1975 | Japan | 50-114226[U] |
| Nov. 1, 1975 | Japan | 50-149508[U] |
| Nov. 1, 1975 | Japan | 50-149509[U] |
| Nov. 10, 1975 | Japan | 50-152804[U] |
| Nov. 19, 1975 | Japan | 50-157082[U] |
| Dec. 17, 1975 | Japan | 50-170910[U] |
| Dec. 22, 1975 | Japan | 50-174124[U] |

[51] Int. Cl.[2] ..... G10C 3/04

[52] U.S. Cl. ..... 84/1.14; 84/1.16; 84/173

[58] Field of Search ..... 84/1.01, 1.14–1.16, 84/DIG. 23, 171, 173, 174, 177, 184

[56] References Cited

U.S. PATENT DOCUMENTS

| | | | |
|---|---|---|---|
| 1,962,410 | 6/1934 | Wegel | 84/1.16 |
| 2,038,995 | 4/1936 | Hammond, Jr. | 84/1.16 |
| 2,505,804 | 5/1950 | Stein | 84/177 |
| 3,049,958 | 8/1962 | Benioff | 84/1.16 |
| 3,519,721 | 7/1970 | Martin et al. | 84/1.14 |
| 3,530,228 | 9/1970 | Scherer | 84/1.16 |
| 3,543,630 | 12/1970 | Ferris et al. | 84/177 |
| 3,931,752 | 1/1976 | Mussuzman | 84/1.16 |

*Primary Examiner*—Robert K. Schaefer
*Assistant Examiner*—Vit W. Miska
*Attorney, Agent, or Firm*—Haseltine, Lake & Waters

[57] ABSTRACT

An electric piano having a casing provided with a frame made as a casting or the like with a plurality of strings stretched on the piano and supported at intermediate portions by a bridge member. A plurality of hammers driven by respective keys strikes the strings and pickups are provided for detecting vibrations of the strings. An amplifier is connected to the pickups and a speaker is connected to the amplifier. The bridge member is supported on supporting members attached to the frame through shock absorbing members of rubber or the like, and the pickups are constituted by piezoelectric elements mounted at any desired position in the supporting members.

12 Claims, 17 Drawing Figures

ELECTRIC PIANO

FIELD OF THE INVENTION

This invention relates to an electric piano.

PRIOR ART

An electric piano as known in the prior art is shown in FIG. 1 wherein a string 2 is stretched on a frame 1, and a bridge member 3 on the frame 1 is provided with a lateral groove 4 open at its side surface, pickup or transducer 5 comprising a piezoelectric element being contained in the groove so that an electrical signal taken from the pickup 5 may be amplified for obtaining a piano tone from a speaker.

This arrangement is disadvantageous in that vibration of the string 2 cannot be reproduced with a high fidelity. The reproduction is poor especially in the high and low frequency ranges and the electrical signal obtained therefrom must be electrically compensated.

SUMMARY OF THE INVENTION

An object of the invention is to provide an electric piano free from the disadvantages noted above.

According to the invention, in an electric piano of the type in which an electric piano casing is provided with a frame made as a casting or the like and having a plurality of strings stretched thereon and supported at intermediate portions by a bridge member, a plurality of hammers being arranged to move with respective keys, pickups for detecting vibration of the strings, an amplifier connected to the pickups and a speaker connected to the output of the amplifier, an improvement is provided characterized in that the bridge member is supported on supporting members attached to the frame through shock abosrbing members of rubber or the like, and the pickups comprising piezoelectric elements are mounted on any desired portion of the supporting members.

DETAILED DESCRIPTION

Figure 2:
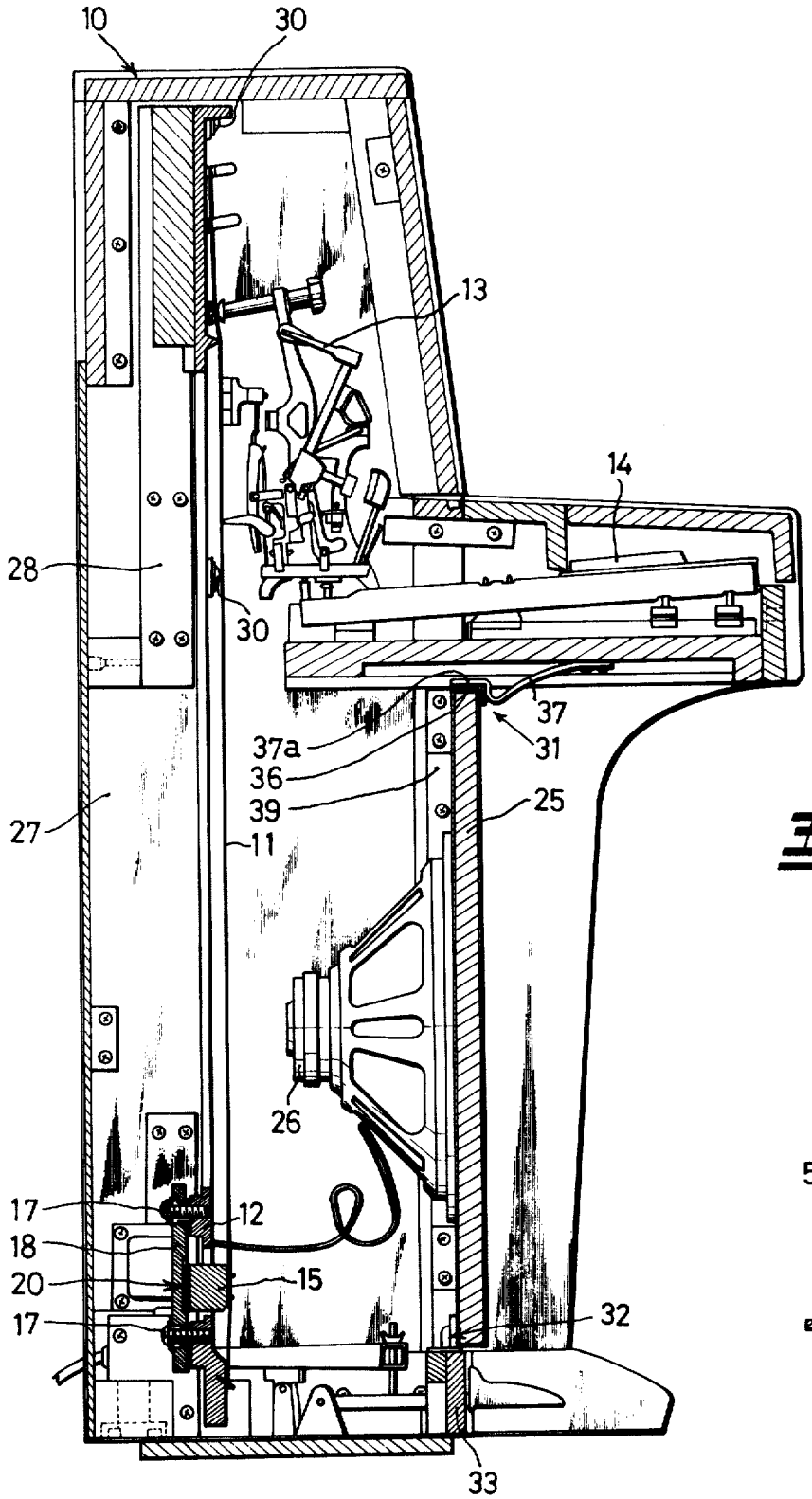
FIG. 2 is a sectional side view of one embodiment of an electric piano according to the invention.
Figure 1:
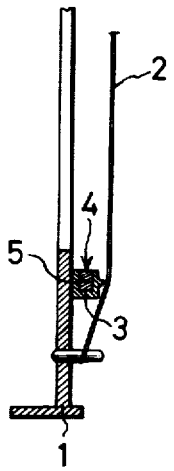
FIG. 1 is a sectional side view of a portion of a conventional electric piano.
Figure 3:
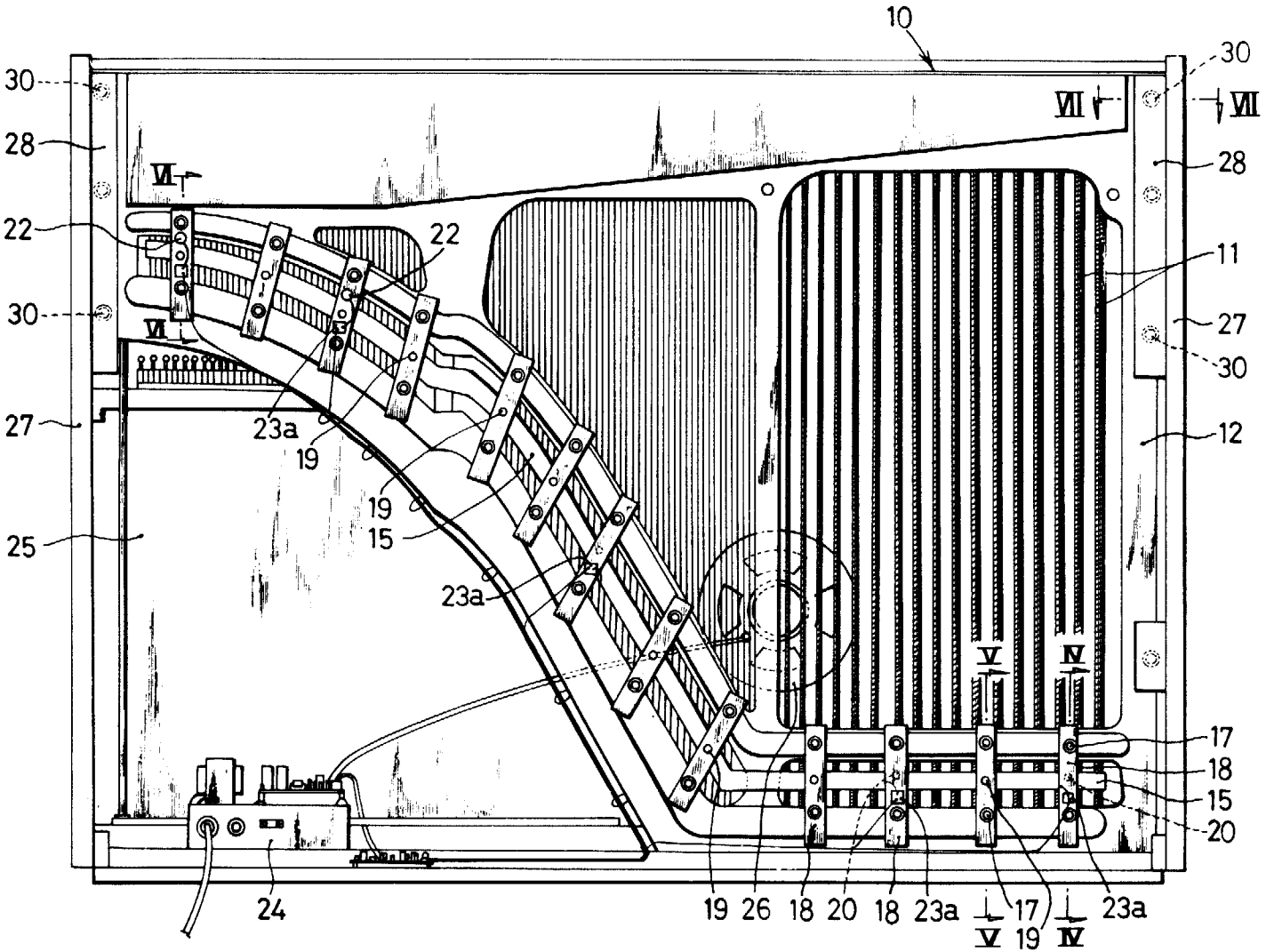
FIG. 3 is a rear side view thereof with the rear plate removed.

Referring to FIGS. 2 to 8 showing one embodiment of the invention, numeral 10 denotes a casing of the electric piano arranged in almost the same manner as a conventional piano in that the casing 10 supports a frame 12 made as a casting and having a plurality of strings 11 stretched thereon and the piano is provided with a plurality of hammers 13 for striking the strings 11 and with a keyboard 14 for operating the hammers 13.

Numeral 15 denotes a bridge member attached to supporting members 18 comprising a plurality of small separate wood bars each connected at its upper and lower portions to the frame 12 through shock absorbing members 16 by means of bolts 17, as shown clearly in FIG. 2 to 6. The shock absorbing members 16 each comprises a rubber bushing **16*a* and a rubber packing 16*b*. Numeral 19 denotes a wood screw connecting the bridge member 15 to the supporting members 18. In the range of low and middle tone sections of the bridge member 15, three pickups 20 are employed and each thereof is mounted between the supporting member 18 and the bridge member 15 as shown clearly in FIG. 4. Each pickup 20 comprises a piezoelectric element 20*a* and a pair of electrode plates 20*b* adhered to the upper and lower surfaces thereof. Numeral 21 denotes a recessed portion in the supporting members containing the pickup 20 for preventing movement thereof. This recessed portion is not required when the pickup 20** is attached by an adhesive agent.

Figure 6:
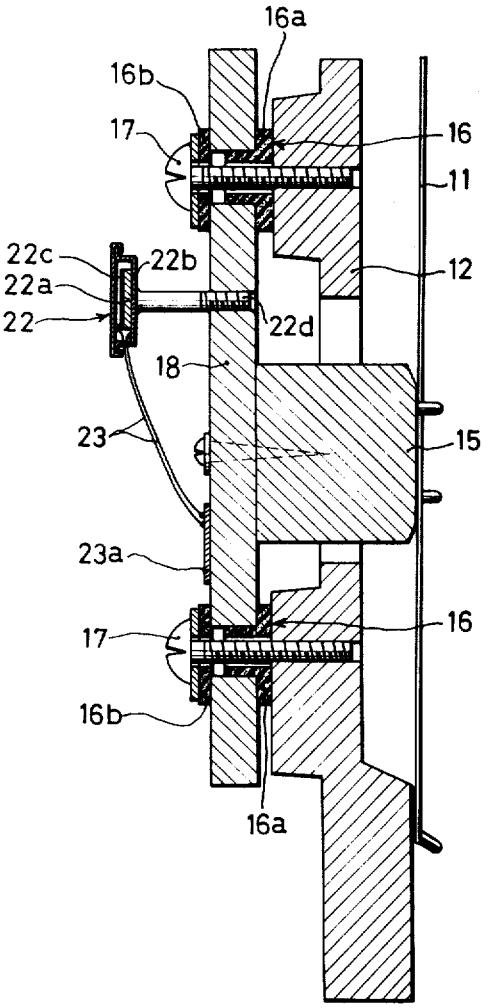

In the high frequency tone section of the bridge member 15, two pickups 22 are used and each is attached to the supporting member 18 as shown clearly in FIGS. 2 and 6. Each pickup 22 comprises a piezoelectric element **22*a*, a casing 22*b* constituting one electrode and another electrode 22*c* contained within the casing 22*c*, the pickup being screwed in the supporting member 18 by means of a screw 22*d* projecting integrally from the casing 22*b***.

Lead wires 23 from the pickups 20 and 22 are connected to an amplifier 24 through respective intermediate base plates **23*a* attached to the respective supporting members 18. An output terminal of the amplifier 24 is connected to a speaker 26 attached to a lower front plate 25 of a lower front section of the casing 10**.

Thus, vibrations of the strings 11 produced by operating the keyboard 14 are transmitted through the bridge member 15 to the supporting members 18. Each supporting member 18 is supported on the frame 12 through the shock absorbing member 16, so that the member 18 serves as a sound-board. Namely, it acts and vibrates in almost the same manner as the sound-board of a conventional piano, so that signals taken therefrom through the pickups 20 and 22 are extremely close to the signals obtained from the sound-board of a conventional piano.

A signal close to a piano tone can be obtained even if the pickups 20 and 22 are each attached at any position of the supporting member 18. However, a higher fidelity reproduction of the low and middle frequencies can be obtained if each of the pickups 20 is interposed between the bridge member 15 and the supporting member 18 and a higher fidelity reproduction of the high frequencies can be obtained if each of the pickups 22 is attached to the outside surface of the supporting member 18.

Figure 7:
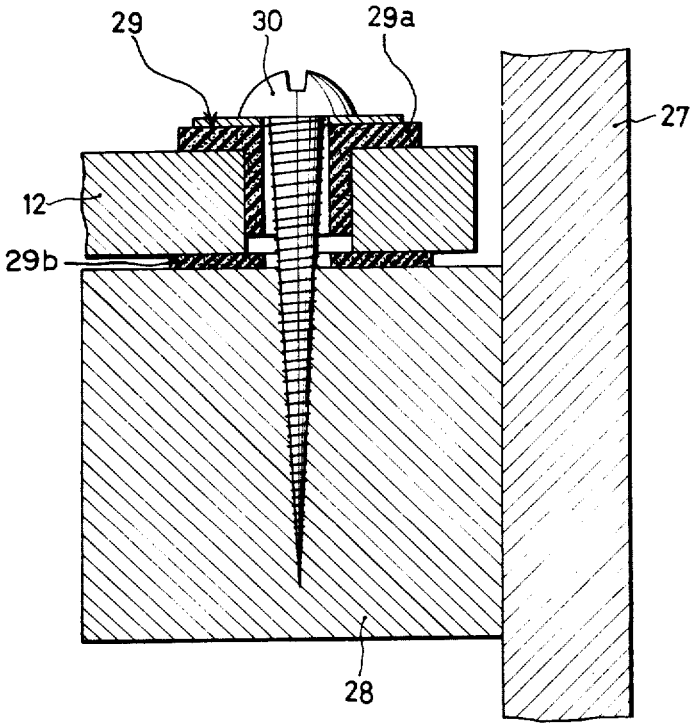

Referring to FIGS. 2 and 7, numeral 27 denotes opposite main plates constituting the casing 10, and vertical projecting rods 28 are provided on the inner surfaces of main plates 27, and the frame 12 is supported on rods 28 through shock absorbing members 29 by means of screws 30. The shock absorbing members 29 each comprises a rubber bushing 29a and a rubber packing 29b.

Figure 8:
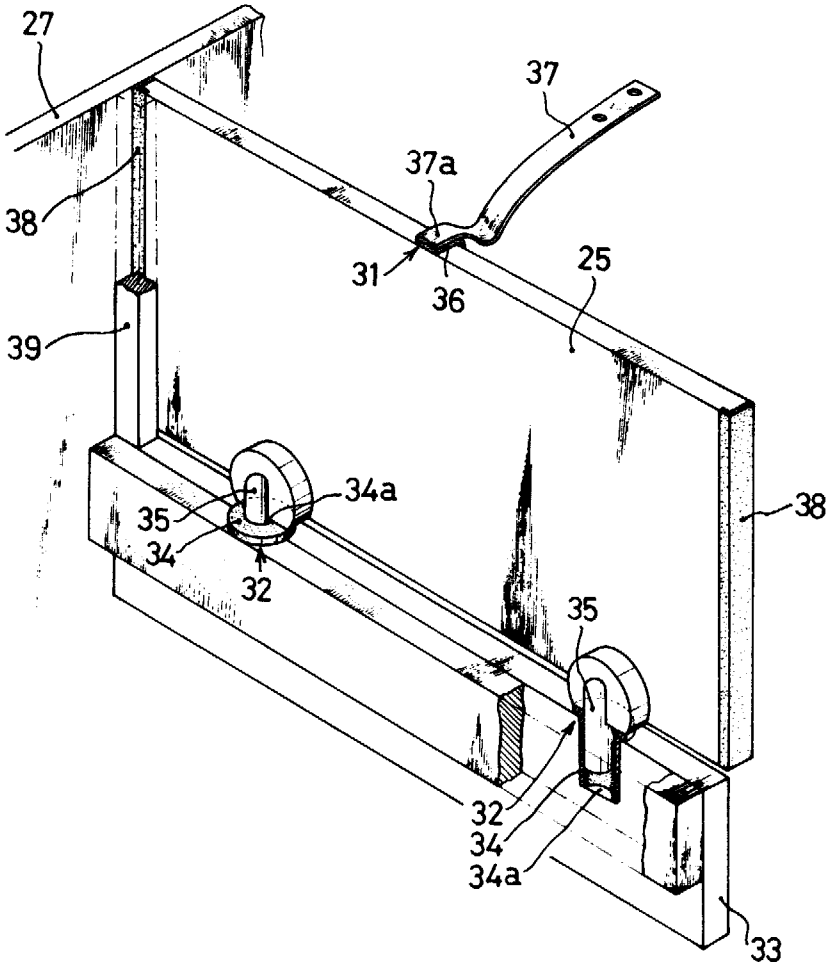
FIG. 8 is a perspective view of a lower front plate section of the piano.

As shown in FIG. 8, the lower front plate 25 carrying the speaker 26 is connected at its upper and lower edges to the casing 10 through shock absorbing members 31 and 32. The lower shock absorbing members 32 each comprises a rubber bushing 34 embedded in a lateral plate 33 of the front lower end portion of the casing 10 and a synthetic resin pin 35 projecting downwards from the lower edge at the inner surface of the lower front plate 25 so as to be mounted in an opening 34a of the bushing 34. The upper shock absorbing member 31 comprises a felt strip 36 attached to an upper edge of the lower front plate 25 and a spring 37 engaged with the felt strip 36. Thus, the lower front plate 25 can be supported on the casing 10 in shock absorbing fashion by inserting the pin 35 into the openings 34a of the rubber bushings 34 and bringing the felt strip 36 into engagement with engaging portion 37a of the spring 37. Numerals 38 denoted resilient members made of rubber or the like attached to opposite sides of the lower front plate 25, and the opposite sides of the plate 25 are received via the resilient members 38 on projecting rods 39 on the main plates 27.

Thus, any vibration of the lower front plate 25 caused by driving of the speaker 26 is prevented from being transmitted to the casing 10, and even should some vibration be transmitted, its transmission to the frame 12 is prevented by the shock absorbing support on the frame 12, and there is not caused any howling.

Figures 9, 11:
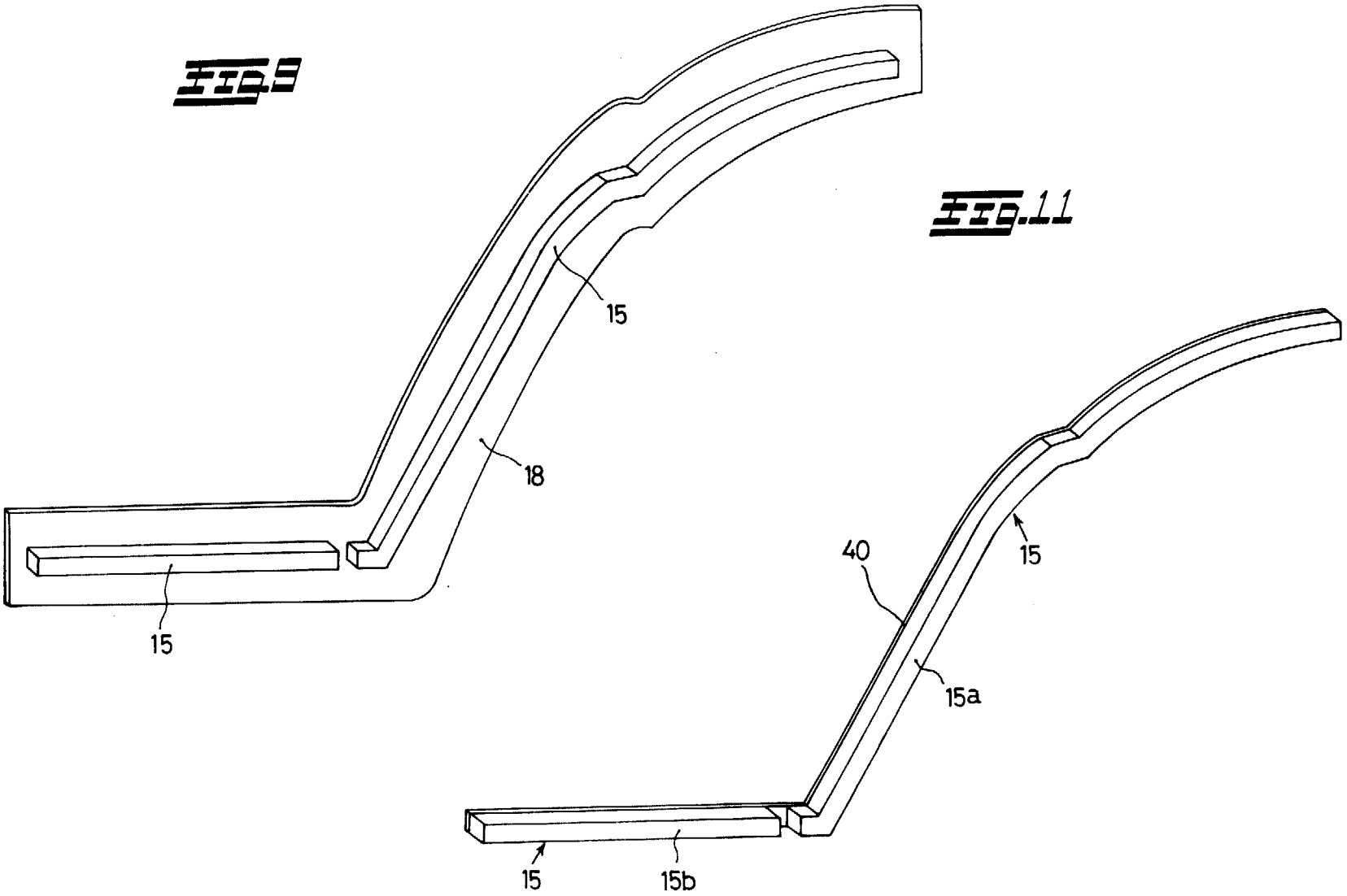
FIG. 9 is a perspective view of another embodiment of a supporting member.
FIGS. 11 and 12 are respective perspective views of two further embodiments of a bridge member.

The supporting members 18 comprising a plurality of small bars are to be designed to be equal in stiffness to the sound board of the conventional piano. Accordingly, if the supporting members 18 are all equal in width and in length, the thickness thereof should be less at the low frequency side and greater in thickness at the high frequency side. The plurality of supporting members 18 may be formed into a single common plate as shown in FIG. 9. In this case, if it has an equal length at every portion in the width direction, the thickness thereof must be less at the low frequency side and greater at the high frequency side. The supporting members 18 may be made either of wood or metal, but it is required in either case that they should be designed to be equivalent in stiffness to the soundboard of the conventional piano.

Figure 10:
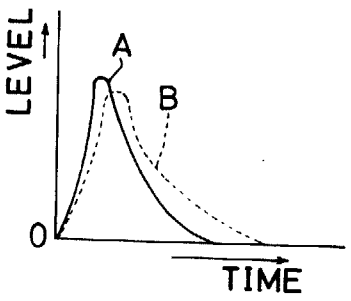
FIG. 10 is a graph showing the output of the electric piano according to the invention.

A high fidelity reproduction of a piano tone can be obtained in the foregoing embodiment, but it cannot be avoided in this case that the response curve is somewhat steep in its rise and fall as shown by solid lines A in FIG. 10 to produce a tone sounding somewhat hard. FIG. 11 shows an improved embodiment wherein the bridge member 15 is made of wood and there is provided along the bottom surface of the bridge member 15 a continuous heavy metallic member 40 made of iron or the like, so that the total weight of the assembly (about 7 — 10 Kgs) is nearly equal to the total weight of the soundboard and the bridge member of the conventional piano. Thus, the response curve becomes comparatively flatter in its rise and fall as shown by the dotted line B in FIG. 10 whereby there is obtained a softer tone.

The bridge member 15 may comprise a bridge member section 15a in the high and middle frequency ranges and a bridge member section 15b in the low frequency range, the two sections 15a, 15b being interconnected by the metallic member 40, so that a tone transition from the middle frequency range to the low frequency range becomes smooth and natural. The metallic member 40 may be integral with the lower surfaces of the bridge members 15a, *l* 15b as mentioned before, but it may be so modified that the member 40 is formed as a channel to surround the lower portion of the bridge members 15a, 15b.

Figure 13:
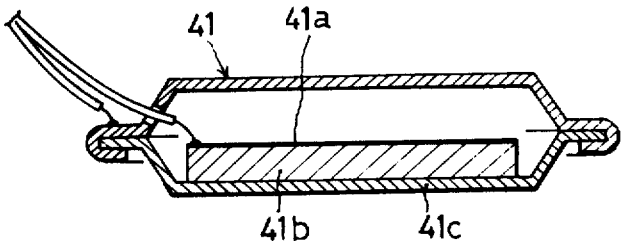
FIG. 13 is a sectional side view of another embodiment of a pickup.

FIG. 13 shows another type of pickup 41. The pickup is constructed so that a piezoelectric element 41b thereof having an electrode 41a formed on one surface thereof is adhered at its other surface to an inside surface of a metallic casing 41c, and the casing is adhered to the supporting member 18, as shown, for example, in FIG. 14. In this embodiment, an excellent reproduction of high frequency tones can be obtained by attaching the pickup to the respective supporting members 18 in the high frequency range.

Figure 4:
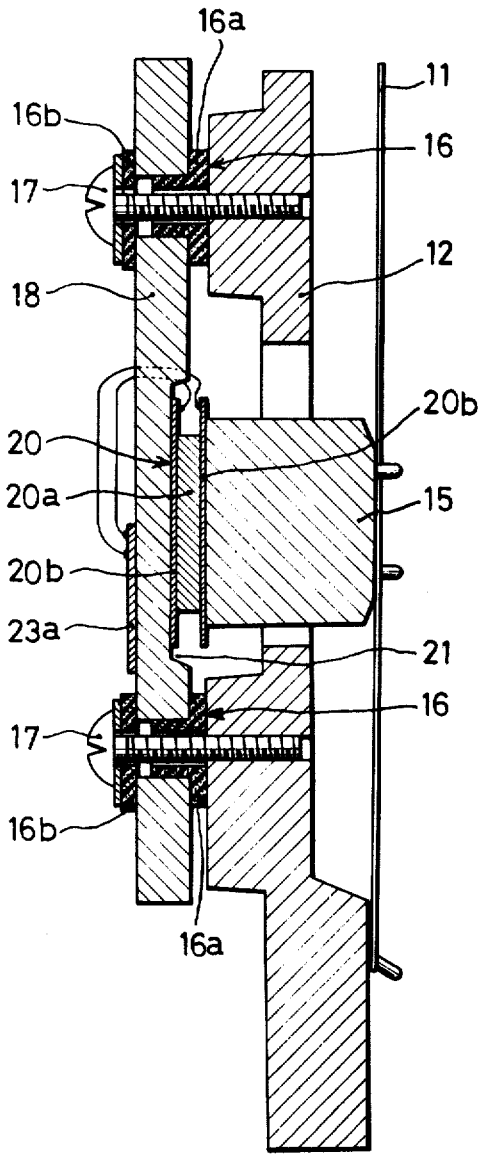
FIGS. 4 to 7 are sectional views taken respectively along lines IV—IV, V—V, VI—VI and VII—VII in FIG. 4.
Figure 5:
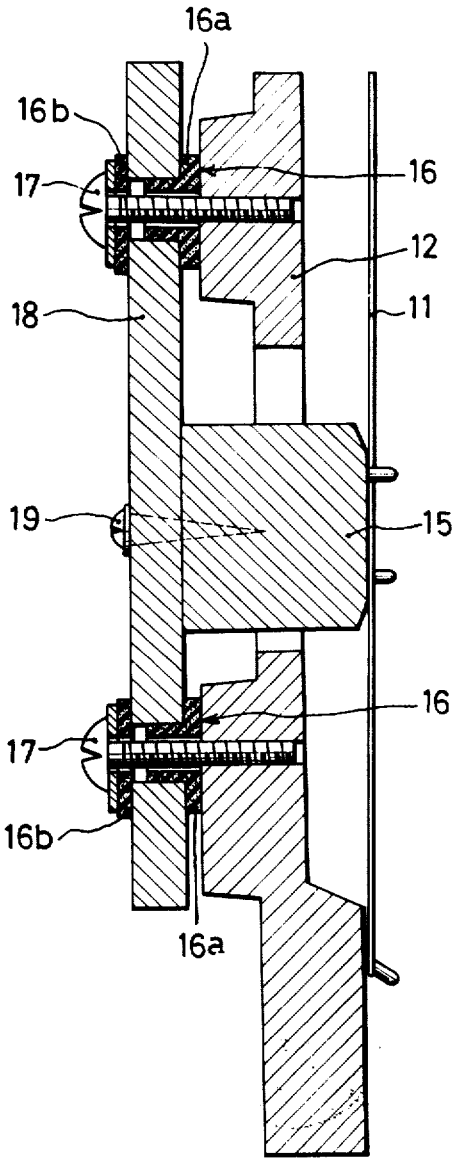
Figure 14:
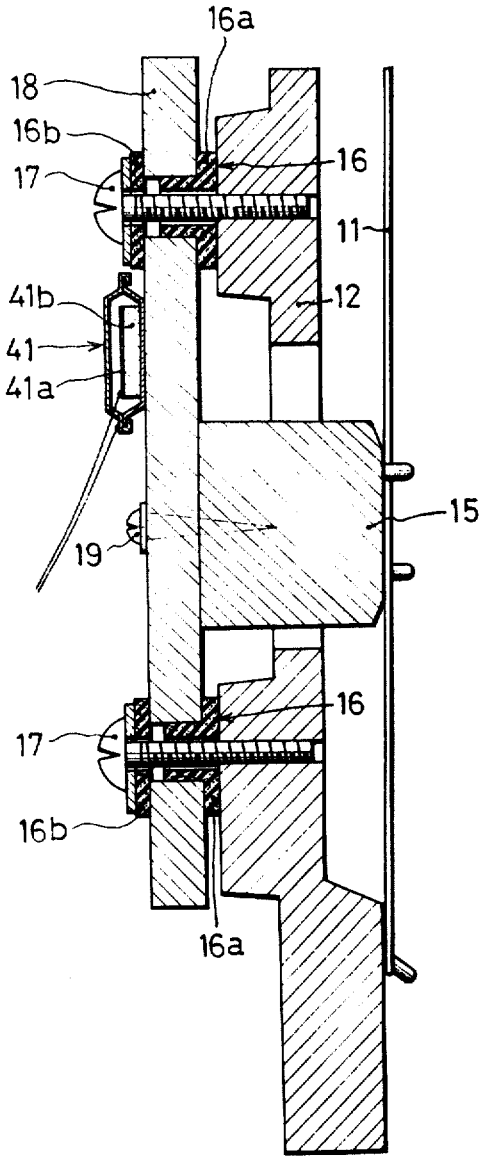
FIG. 14 is a sectional side view thereof in condition of use.
Figure 15:
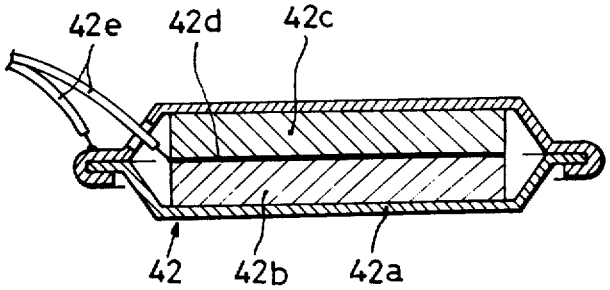

FIG. 15 shows another type of pickup 42. Therein a pair of piezoelectric elements 42b and 42c having an electrode plate 42d clamped therebetween is encased in a metallic casing 42a, and lead wires 42e are led out from the metallic casing 42a and the electrode plate 42d. The pickup may be mounted between the bridge member 15 and the supporting member 18 are shown in FIG. 4 or it may be adhereed to the supporting member 18 as shown in FIG. 14.

Figure 16:
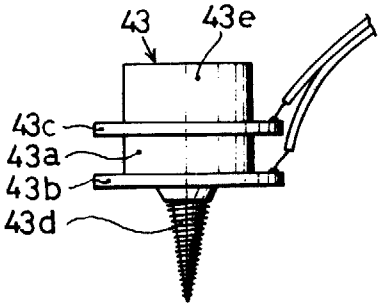
FIGS. 15 to 17 are respective sectional side views of further embodiments of pickups.
Figure 17:
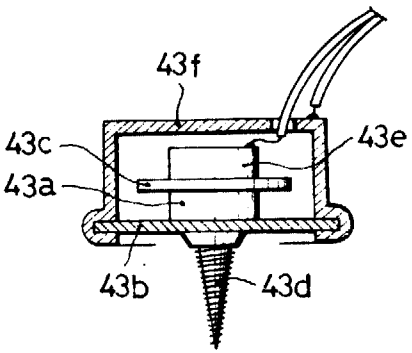
Figure 12:
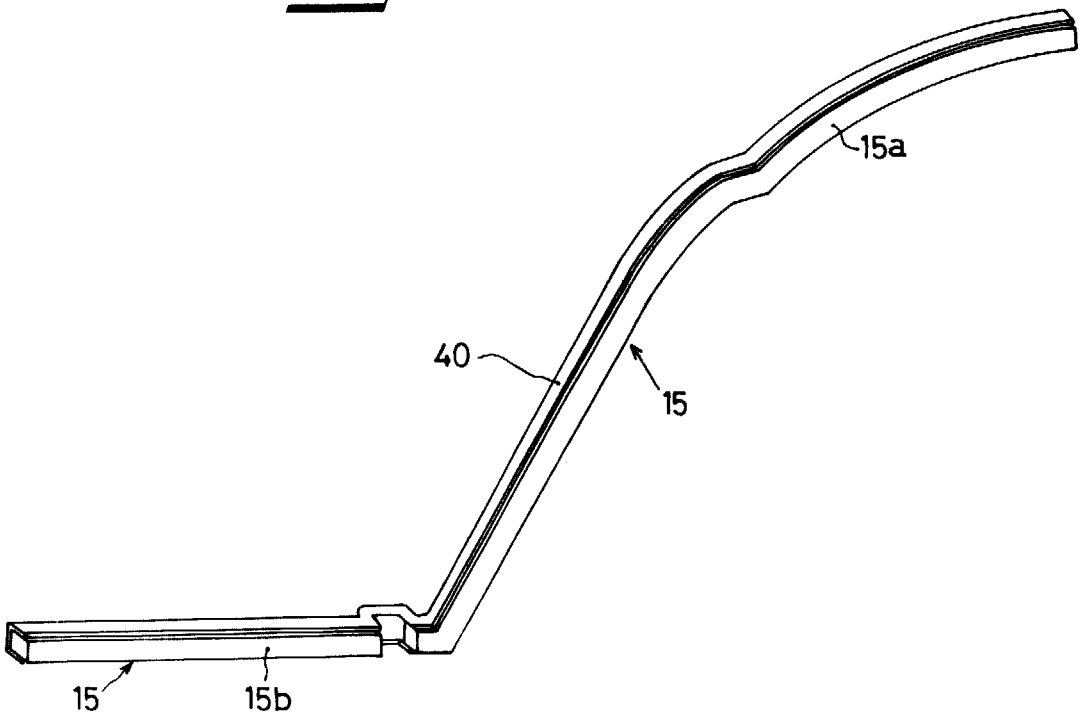

FIG. 16 shows another type of pickup 43. Therein electrode plates 43b and 43c are adhered to opposite surfaces of a piezoelectric element 43a, and a screw 43d is attached integrally to the electrode plate 43b while a weight 43e is adhered to the electrode plate 43c. The pickup 43 is attached to the supporting member 18 by screwing the screw 43d into the supporting member 18 as shown in FIG. 6. The pickup can detect high frequency vibration by the action of the weight 43e and accordingly can be used for the high frequency section. The pickup may be provided with a cap 43f as shown in FIG. 17. In this case, substantially the same effect as that above can be obtained even if the weight 43e is deteched therefrom and the cap 43f is attached instead, or the cap 43f is increased in its own weight.

Thus, according to this invention, the bridge member is supported on supporting members attached through shock absorbing members to the frame, so that the supporting members can act similar to the sound-board of the conventional piano and vibration applied to the supporting members through the bridge member can be taken out as electric signals by the pickups comprising piezoelectric elements whereby tones extremely close to natural piano tones can be obtained.

What is claimed is:

1. In an electric piano having a casing with a frame, a plurality of strings stretched on the frame, a bridge member supporting the strings at intermediate portions thereof, a plurality of hammers for striking the strings, a plurality of keys for actuating the hammers, electrical pickups for detecting vibrations of the strings, an amplifier connected to the pickups and a speaker connected to the amplifier, the improvement comprising a vibratable supporting member supporting said bridge member, means including shock absorbing members dampingly supporting the supporting member on said frame, said pickups comprising piezoelectric elements mounted on the supporting member, said pickups including first pickups mounted between the bridge member and the supporting member in the low and middle frequency range and second pickups attached to the outer surface of the supporting member in the high frequency range, the number of pickups being considerably less than the number of strings, said bridge member being elongated to extend over a multitude of strings, said bridge member constituting a sound-board.

2. An electric piano as claimed in claim 1, wherein the pickups are adhesively secured to the outer surfaces of the supporting member.

3. An electric piano as claimed in claim 1, wherein each pickup further comprises a metallic casing containing the piezoelectric element, and a threaded projection integrally secured to said casing and threadably engaged in the supporting member for being supported thereby.

4. An electric piano as claimed in claim 1, comprising means including shock-absorbing members supporting said frame on the casing.

5. An electric piano as claimed in claim 1 wherein said support member has opposite edge regions, said shock absorbing members supporting said support member to said frame at said edge regions and leaving an unsupported intermediate region of said support member, said bridge member being mounted on said support member in said intermediate region.

6. An electric piano as claimed in claim 1, comprising a lower front plate supporting the speaker, and means including shock-absorbing members supporting said lower front plate on said casing.

7. A electric piano as claimed in claim 1, wherein said bridge member includes a metallic member connected thereto for increasing the weight.

8. An electric piano as claimed in claim 7, wherein said bridge member includes a bridge member section for low frequency tones and a bridge member section for middle frequency tones, said metallic member being joined to both bridge member sections.

9. An electric piano as claimed in claim 1, wherein the said supporting member comprises a plurality of supporting members disposed in spaced intervals from one another.

10. An electric piano as claimed in claim 9 wherein said supporting members are of the same width and length, the supporting members for low frequency tones being of less thickness than the supporting members of high frequency tones.

11. An electric piano as claimed in claim 1, wherein said supporting member is composed of a single common plate.

12. An electric piano as claimed in claim 11 wherein said supporting member has a constant width and is lower in thickness in the low frequency region as compared to the high frequency region.

* * * * *